US006421073B1

(12) United States Patent
Dietel et al.

(10) Patent No.: US 6,421,073 B1
(45) Date of Patent: Jul. 16, 2002

(54) DEVICE FOR POSITIONING PRINTING HEAD ACCORDING TO PRINTING SUBSTRATE THICKNESS

(75) Inventors: Klaus Dietel, Villingen-Schwenningen; Wolfgang Hauslaib, Langenau; Harald Eckel, Neu-Ulm; Johann Stempfle, Pfaffenhofen, all of (DE)

(73) Assignee: Tally Computerdrucker GmbH, Ulm-Elchingen (DE)

( * ) Notice: Subject to any disclaimer, the term of this patent is extended or adjusted under 35 U.S.C. 154(b) by 0 days.

(21) Appl. No.: 09/231,027

(22) Filed: Jan. 14, 1999

(30) Foreign Application Priority Data

Jan. 14, 1998 (DE) ..... 198 01 071
Dec. 12, 1998 (DE) ..... 198 57 450

(51) Int. Cl.[7] ..... B41J 25/308

(52) U.S. Cl. ..... 347/110; 347/8; 347/225; 400/56; 400/59

(58) Field of Search ..... 347/8, 225, 245, 347/263, 110; 400/55, 56, 57, 59

(56) References Cited

U.S. PATENT DOCUMENTS 3,875,920 A * 4/1975 Williams ..... 123/617
4,088,215 A * 5/1978 Bader ..... 400/56
5,051,008 A * 9/1991 Honda et al. ..... 400/59
5,152,620 A * 10/1992 Gomoll et al. ..... 400/352
5,468,076 A * 11/1995 Hirano et al. ..... 347/8 X

FOREIGN PATENT DOCUMENTS

JP 4-197668 A * 7/1992 ..... 347/8
JP 4-197668 A * 7/1992 ..... 347/8

* cited by examiner

*Primary Examiner*—David F. Yockey
(74) *Attorney, Agent, or Firm*—Cohen, Pontani, Lieberman & Pavane

(57) ABSTRACT

A device for positioning a printing head of a printer in response to recording carrier/substrate thickness includes a reflex sensor arranged in a protected space formed between a head-carrying carriage and an opposing printing head housing surface. During printer initialization or upon insertion of a recording carrier/substrate having a thickness greater than a predetermined thickness, the printing head is slightly displaced with respect to the carriage as a result of brief contact of the printing head print surface with the recording carrier that is supported on a printing abutment. The reflex sensor measures the displacement travel distance of the printing head and generates an input signal to an evaluation circuit. The evaluation circuit generates an output control signal to a carriage displacement drive in response to the measured displacement of the print head to automatically set the distance between the printing head and the recording carrier or printing abutment.

10 Claims, 6 Drawing Sheets

DEVICE FOR POSITIONING PRINTING HEAD ACCORDING TO PRINTING SUBSTRATE THICKNESS

BACKGROUND OF THE INVENTION

1. Field of the Invention

The invention relates to printers, and more particularly it relates to a device for setting the operating distance or spacing between the printing head and the recording carrier (e.g., paper).

2. Discussion of the Related Art

During initialization of matrix and ink drop (e.g., ink jet) printers, for example, and/or upon insertion of a new recording carrier/substrate (e.g., paper), the printer generally positions or repositions the printing head to within a predetermined distance from the recording carrier or substrate. In order to provide accurate and optimum printing operation, it is important that this predetermined distance fall within a predefined tolerance limit for the specific printer. Should the paper thickness change, for example due to the use of single-ply paper of different thicknesses or the use of multi-ply paper or multiple sheets, the position of the printing head relative to the printing abutment must be reset in order to ensure optimum printing quality and (in the case of matrix printers) a long printing head life.

A distance setting device (i.e., a device for adjusting the position of the print head to account for the thickness of the recording carrier on which printing is to occur) is known from German Patent No. DE 42 21 265 C2. This type of device presupposes a printing head which is freely movable in a direction perpendicular to the recording carrier and includes thickness sensing rollers. An indirectly generated electronic signal (analog signal) emanates from the thickness sensing rollers and is fed to a control unit for the distance setting. In order to produce the signal, a first magnetic element for generating a first magnetic flux is located on the thickness sensing roller. A second magnetic element, generating an opposite second magnetic flux, is located on the printing head carriage. A Hall element is arranged on the printing head carriage in the region of the second magnetic flux, and when a recording carrier is present and the printing head carriage is in a specific lateral position, the drive motor of the distance setting device is activated. The drive motor remains active until the voltage corresponding to an intended or predetermined air gap is applied to the Hall element. This device works relatively accurately, but its accuracy should and can be increased even further. Moreover it is, in part, located in a relatively accessible place on the printing head carriage and is therefore not completely safeguarded from external actions such, for example, as contamination.

Another distance setting device, disclosed in German Patent No. DE 196 11 772 A1, is based on transport rollers which are capable of being resiliently set to the paper thickness and are arranged in pairs on a rigidly mounted driven shaft and on an axis perpendicular to the recording carrier. A measurement signal transmitter arranged on this axis transmits light and cooperates with a measurement signal receiver located on the printing head carriage. Moreover, a position indicator is provided for the printing head carriage. Measurement signals received by the measurement signal receiver are compared with clock pulses of the position indicator, both in the absence of paper and with paper inserted. Based on the resulting difference signal, the printing head distance drive device is operated by a control unit. This type of distance setting device is admittedly cost-effective, because only the measurement signal transmitter and a conventional measurement signal receiver are required. However, it is necessary for the light barrier formed by the light transmitter and light receiver to have highly accurate and stable switch points which cannot be maintained when the ambient and/or operating temperatures for the printer change.

One object on which the invention is based is to eliminate the effect of vibrations caused by stepping motors and the like as they operatively move the carriage supporting the printing head, which often prevent accurate measurement and setting of spacing tolerances between the measuring point and the printing head end face, and thereby to achieve more accurate measurements of the printing substrate thickness and print head position than are attainable in prior art arrangements.

SUMMARY OF THE INVENTION

These and other objects are achieved, in accordance with the invention, in a construction in which the printing head is slightly displaceable (deformable) on the supporting carriage as a result of brief contact with the recording carrier which is supported or carried on the printing abutment. The displacement travel (i.e. distance) and/or a displacement angle of the printing head relative to the recording carrier is measured by means of a reflex sensor located in a clearance defined between the carriage and an opposing printing head housing surface. The result of this measurement, in the form of a processed output signal from an evaluation circuit, controls the drive for automatically setting the spacing of the printing head from the recording carrier or from the printing abutment. During brief contact of the printing head with the recording carrier, a slight "deformation" (which amounts to only a few $\mu$m) of the printing head on and relative to the carriage occurs and is recorded as a signal change by the reflex sensor without any other disturbing influence. This measuring operation can be triggered automatically and is independent of carriage position.

A reliably determined position of the printing head on the carriage is nevertheless obtained, since the printing head is fastened to the carriage by a spring with a front part facing the carriage and with an elastic intermediate layer interposed between the carriage and print head.

The principle of the reflex sensor of the invention may be employed or implemented in many different embodiments. For example, it is contemplated that the reflex sensor be formed from a pairing arranged on the carriage and printing head housing and implemented by a light emitting diode (LED) and a phototransistor located adjacent the LED and both disposed on a surface of the carriage, and a reflex surface disposed opposite the LED and phototransistor on a surface of the printing head housing.

According to another embodiment, the reflex sensor pairing may be formed by a Hall sensor arranged on the carriage and an opposing magnet fastened to the printing head housing.

Furthermore, the desired reflection of waves or beams can also be achieved by forming the reflex sensor pairing as a magnetically sensitive resistor arranged on the carriage in conjunction with an opposing magnet fastened to the printing head housing.

For reflection of optical beams, it is advantageous if the reflex surface of the reflex sensor is implemented by a mirror. Simple polished metal plates are suitable for use as a mirror, and it is unimportant whether reflection is diffuse or specular.

For all electronic or optical elements operating with waves or beams, the presence of external action or external influences on the waves or beams is harmful to the intended functionality. For this reason, in accordance with this invention the pairing, whether implemented by the light emitting diode/phototransistor and associated reflex surface or the Hall sensor and magnet or the magnetically sensitive resistor and magnet, or any other construction, is disposed in a protected space defined, for example, between an enlarged part of the printing head housing and a surface of the carriage that faces away from the printing abutment.

When the printing head is moved toward the recording carrier or the printing abutment, only a very small electric signal is obtained which would be very difficult, if at all, to process. It is therefore desirable that the phototransistor be capable of recording the resulting change in the signal as the printing head is driven into abutment with and contacts the recording carrier.

In accordance with further features of the invention, the signal is modified in that the signal change is fed in the form of a difference signal to an evaluation circuit in which it is amplified and filtered. In the modified control signal thus obtained at the output of the evaluation circuit, the filtered signal change has been freed of residual interference by an amplifier module using a voltage threshold to define the output signal from the evaluation circuit.

In other embodiments it may be undesirable to position the reflex sensor at the printing head, as when displacement of the printing head is not desired or when a rigid connection of the printing head with the carriage is appropriate to precisely position the printing head on the carriage, as for example with printing heads that are easily exchangeable. In these cases reflex sensor assembly may be arranged and disposed separate from the printing head.

Accordingly, it is also an object of the present invention to generate the measuring signal for the reflex sensor at a location separated or spaced from the printing head without interfering with the ability to obtain a precise measurement and the stable position of the printing head.

This additional object is achieved, in accordance with the present invention, by effecting a brief contact of a resiliently formed element on or portion of the carriage with the recording carrier and/or the printing abutment. This brief contact of the element with the recording carrier and/or printing abutment causes a change in a displacement distance and/or angle that is detected by the reflex sensor. In this alternative embodiment any desired mounting of the printing head can be chosen while maintaining the intended precision of measurement.

The resilient element of the carriage for the reflex sensor measurement may be implemented in many ways. In one advantageous embodiment the resiliently implemented element is formed by a resilient angled carriage portion having a first arm carrying a protrusion disposed confrontingly opposite the recording carrier and printing abutment, and a second arm carrying a part of the reflex sensor. This embodiment is based on ease of manufacturing and provides for the measuring signal to be transferred to the reflex sensor safely and without causing the measuring signal to be transmitted a long distance.

Another embodiment implements the resiliently formed element using a resiliently mounted sensor whose front end forms a protrusion disposed confrontingly the recording carrier and whose rear side is part of the reflex sensor. Since the carriage must be positionable in the direction of the recording carrier and printing abutment, respectively, the sensor will not be in contact with the paper during the time of measurement which lasts only microseconds or less and thus does not interfere with the printing process or paper transport. The positioning of the sensor within a protected space is achieved in these alternate embodiments, in that the reflex sensor is arranged on the carriage within a predetermined slot or space the light emitting diode/phototransistor are disposed at a first side of the slot and the reflex surface is disposed at the opposite side of the slot.

In this second alternate embodiment the resilient element is bolt-shaped and is provided at its distal end with the reflex surface. In this manner, the reflex surface moves with the element, while the light emitting diode and phototransistor are rigidly carried on the carriage.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference numerals denote similar elements throughout the several views.

DETAILED DESCRIPTION OF PREFERRED EMBODIMENTS

Figure 1:
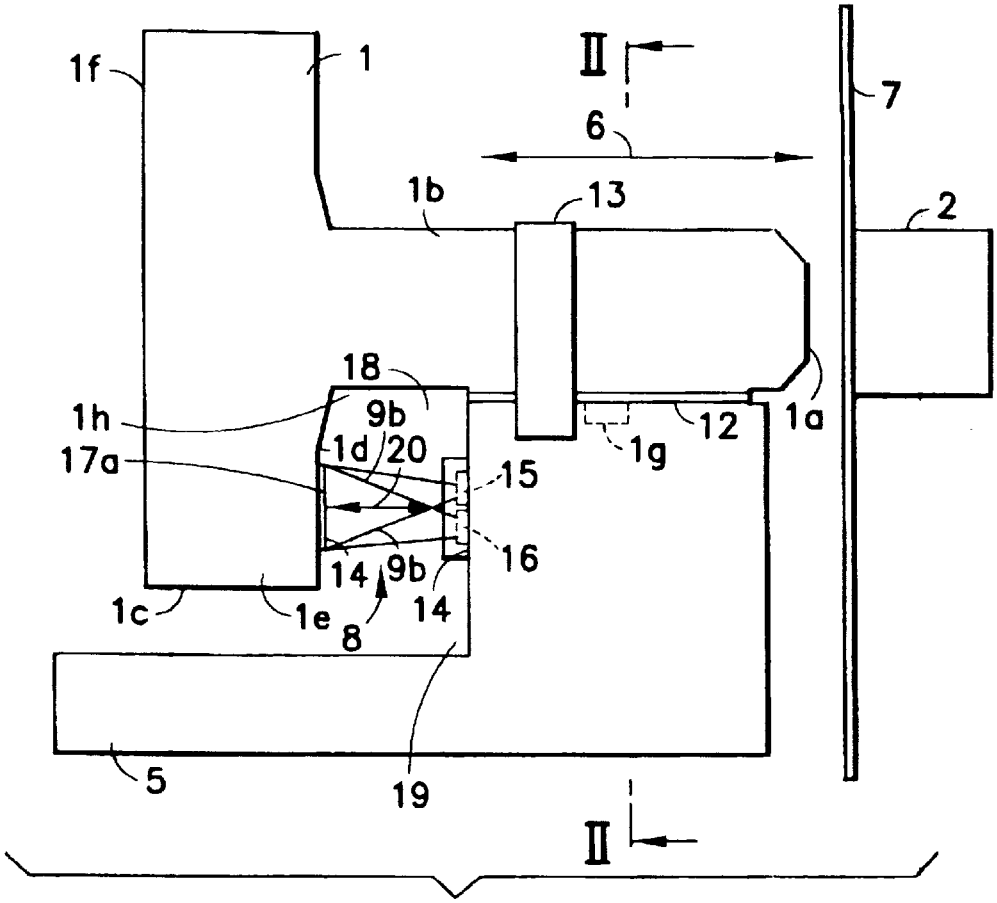
FIG. 1 is a side view of a printing head carried on a carriage that is movable perpendicular to the drawing plane and in accordance with an embodiment of the invention.
Figure 2:
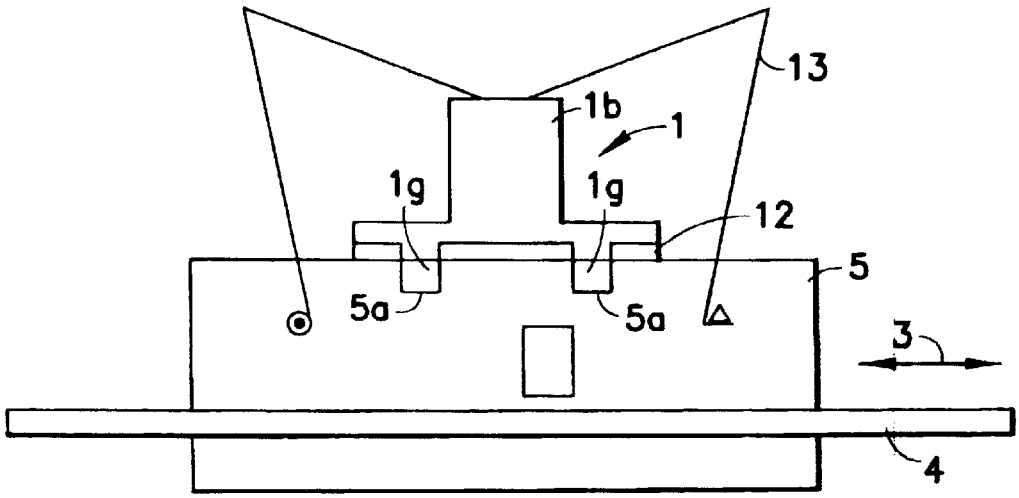
FIG. 2 is a cross sectional view of the carriage with the printing head disposed thereon, taken along the line II—II in FIG. 1.

Referring now to FIGS. 1 and 2, a distance setting device for the printing head 1 with respect to the recording carrier 7 in accordance with the present invention includes a carriage guide 4 extending parallel to the printing abutment 2 and in the movement direction 3 of carriage 5. In order to set the most advantageous distance or spacing between the printing head end face 1*a*, on which the printing elements (styluses and ink nozzles) are located, and the printing abutment 2 supporting or carrying thereon a varying thickness recording carrier 7, printing head 1 in combination with carriage 5 can be slightly displaced in direction 6 substantially perpendicular to printing movement 3. The varying thickness of recording carrier 7 is, for example, attributable to different paper thicknesses and/or different numbers of paper plies and/or sheets. The distance between the printing head end face 1*a* and the recording carrier 7 or printing abutment 2 may, for example, be measured by means of a sensor. The displacement of the carriage 5 along the direction 6 is then controlled and automatically set by means of a drive (not shown) in accordance with the measurement result.

As shown in FIG. 1, printing head 1 has a front part 1*b* and a larger rear part 1*c* (for accommodating the electromagnetic coils and armature in the case of matrix printers). As a result of contact between the printing head 1 and recording carrier/substrate 7, the printing head housing If is displaced relative to the carriage 5. The linear displacement travel (distance) 9*a* and/or angular displacement 9*b* is measured by a reflex sensor 8. Reflex sensor 8 is disposed in a free space 18 formed by and between surface 1*d* on the lower part 1*e* of the print head housing 1*f*, an opposing surface 19 of carriage 5, and a lower surface 1*h* of the front part 1*b* of print head 1. A clearance 20 is defined as the distance between surface 1*d* and surface 19. Reflex sensor 8 measures the linear displacement distance 9*a* and/or displacement angle 9*b* resulting from the contact of print head 1 with recording carrier/substrate 7 in either mode of operation. The measurement result serves as an input signal to an evaluation circuit 11 (FIG. 4), and operates to control the carriage displacement drive (not shown) in the direction 6 to thereby automatically set the distance of printing head 1 with respect to recording carrier 7 or printing abutment 2. Thus, the linear displacement distance 9*a* and/or angular displacement 9*b* are derived from the input signal which forms the basis for the resulting new neutral position of the printing elements (styluses or ink nozzles) in response to paper of different thicknesses or a different number of paper plies or sheets.

In accordance with one contemplated mode of operation, when the printer is initialized as a result of being powered up or reset, carriage 5 carrying print head 1 thereon is controllably advanced toward the recording carrier 7 along direction 6 so as to cause print head 1 to initially abut the same and be rearwardly displaced with respect to carriage 5. In a second alternative mode of operation, print head 1 is initially spaced from printing abutment 2 by a factory-set or user-adjusted distance so as to accommodate a single-ply recording carrier 7 having a standard or predetermined thickness. In the presence of a recording carrier/substrate having a thickness greater than the standard/predetermined thickness, print head 1 will contact or abut the recording carrier/substrate 7 and thereby be rearwardly displaced with respect to carriage 5. The measured displacement distance 9*a* and/or displacement angle 9*b* of print head 1 with respect to carriage 5 is then processed for use in automatic adjustment of the position of print head 1 relative to recording carrier/substrate 7.

Printing head 1 may be vertically mounted and fastened on carriage 5 by means of a spring member 13 that presses the head against the carriage, with an elastic intermediate layer 12 being interposed between printing head 1 and carriage 5 (FIG. 2). Printing head 1 includes two pegs 1*g* which pass through intermediate layer 12 and engage peg holes 5*a* of the carriage 5. Elastic intermediate layer 12 enables printing head 1 to be slightly displaced both linearly and angularly with respect to carriage 5.

Reflex sensor 8 forms a pairing 14 between the carriage 5 and printing head housing if. A first side or part of the pairing is made up of a light emitting diode (LED) 15 and a phototransistor 16 located at a lateral distance from LED 15 and in the same plane. For example, in the illustrated embodiment LED 15 and phototransistor 16 are both adjacently arranged on a surface 19 of carriage 5. The second side of pairing 14 includes a reflex surface 17 arranged opposite LED 15 and phototransistor 16 on a surface 1*d* of the printing head housing 1*f* and can be implemented by a mirror 17*a* (FIG. 1). In operation, LED 15 emits an optical signal that is reflected by reflex surface 17 and then received by phototransistor 16. In response to the received reflected signal, phototransistor 16 produces an output signal from which the distance between surface 1*d* and surface 19 can be derived.

Figure 5:
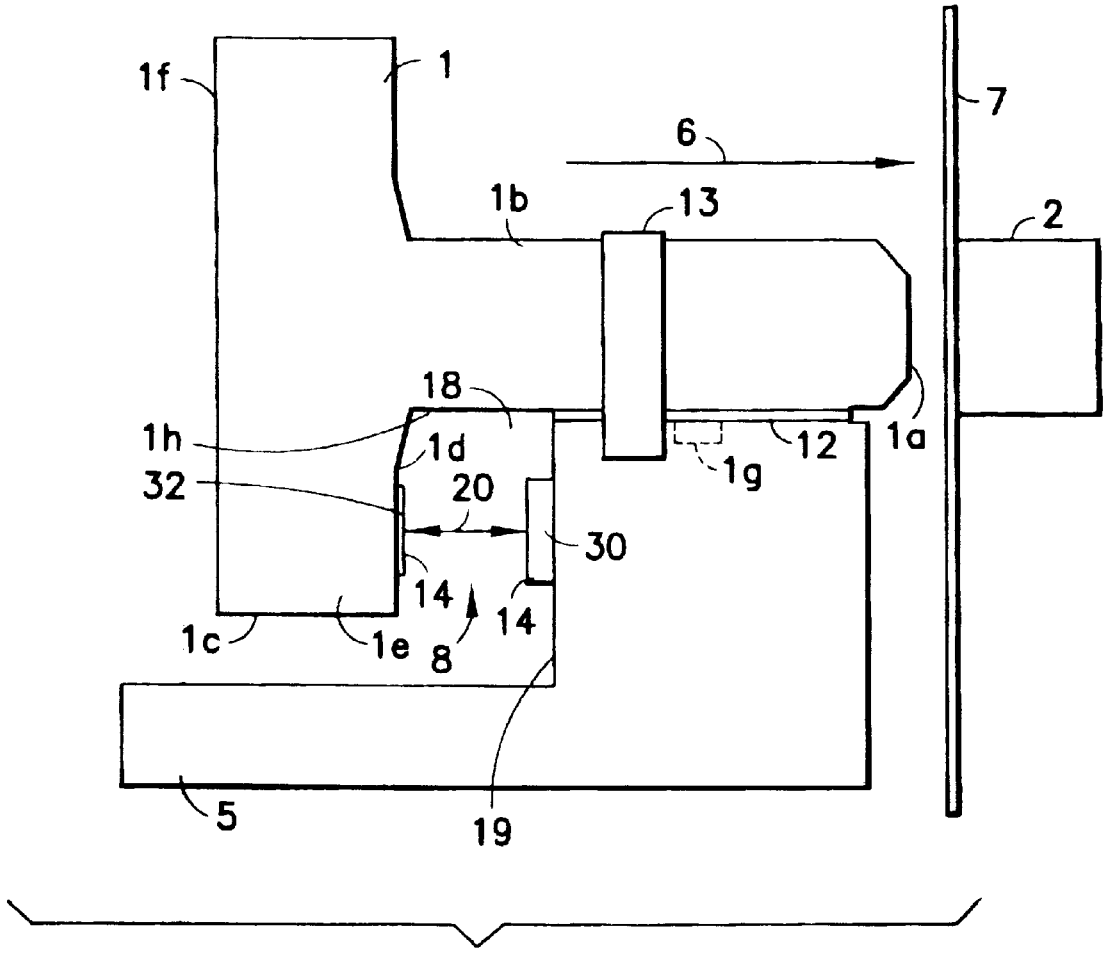
FIG. 5 is a side view of a printing head carried on a carriage that is movable perpendicular to the drawing plane according to another embodiment of the invention.

In another embodiment, reflex sensor 8 may form the pairing 14 using a Hall sensor 30 arranged on carriage 5 and an opposing magnet 32 fastened to printing head housing 1*f* (FIG. 5). Hall sensor 30 is sensitive to the magnetic field created by magnet 32 and, in response to changes in the magnetic field caused by variations in the distance between the two, produces an output signal from which the distance variation between surface 1*d* and surface 19 can be derived.

Figure 6:
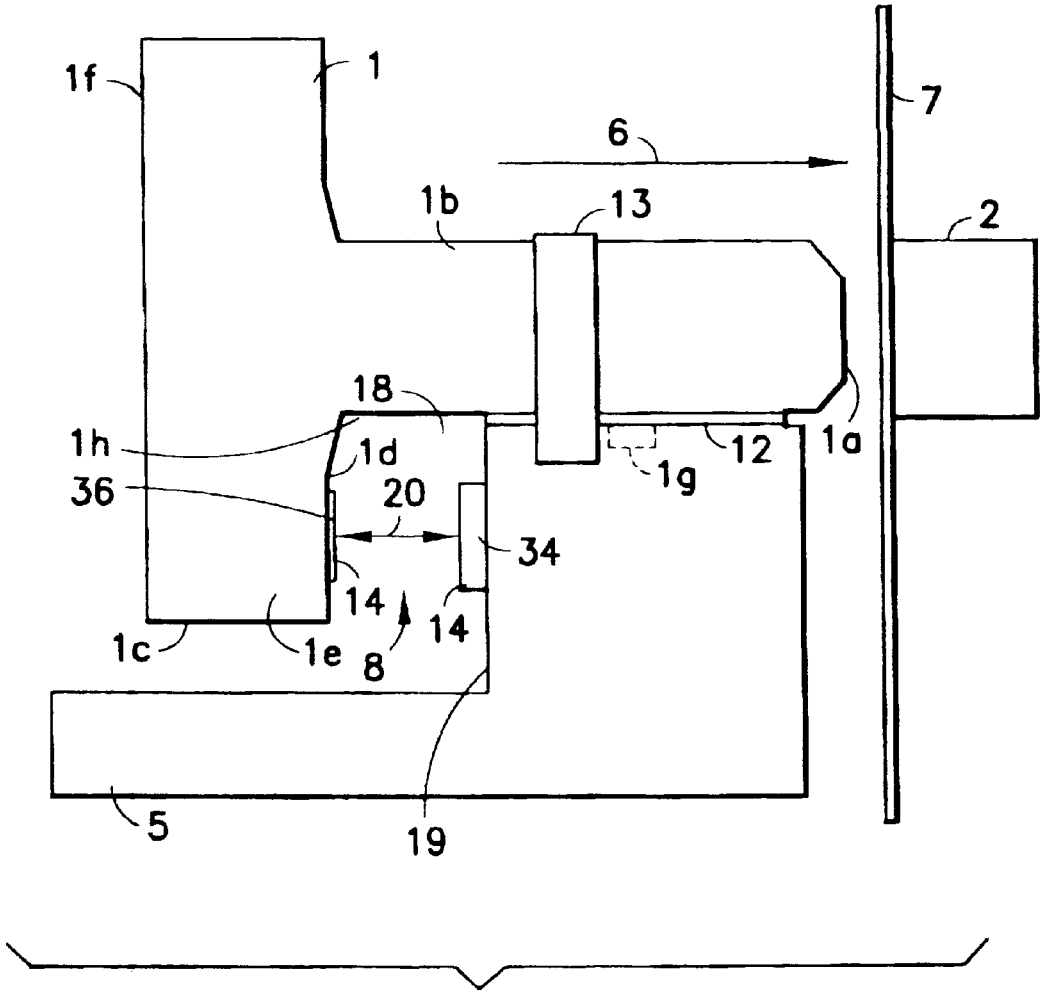
FIG. 6 is a side view of a printing head carried on a carriage movable perpendicular to the drawing plane according to a still further embodiment of the invention.

Another embodiment for providing the pairing 14 is implemented by a magnetically sensitive resistor 34 arranged on carriage 5 and an opposing permanent magnet 36 on printing head housing 1*f* (FIG. 6). Resistor 34 senses the magnetic field created by magnet 36, and in response to changes in the detected magnetic field, outputs a signal from which the distance variation between surface 1*d* and surface 19 can be derived.

For each embodiment of pairings 14, a protected space 18, defined by a surface 1*d* of print head housing 1*f*, surface 19 of carriage 5 (facing away from printing abutment 2) and surface 1h on the lower side of the front part 1*b* of print head 1, is provided by means of an appropriate design of the printing head housing 1*f*.

According to an embodiment of the present invention, the measuring method uses the reflex sensor 8 to determine a signal change 23 (FIG. 3) resulting from the displacement of the printing head 1 with respect to carriage 5. When printing head 1, together with carriage 5, moves in the direction 6 toward recording carrier 7 resting on the printing abutment 2, deformation (i.e., displacement) of both printing head 1 and carriage 5 occurs. Printing head 1, however, will also be displaced with respect to carriage 5, causing the physical distance or clearance 20 between the respective elements of pairings 14 to change (i.e., become greater).

Figure 3:
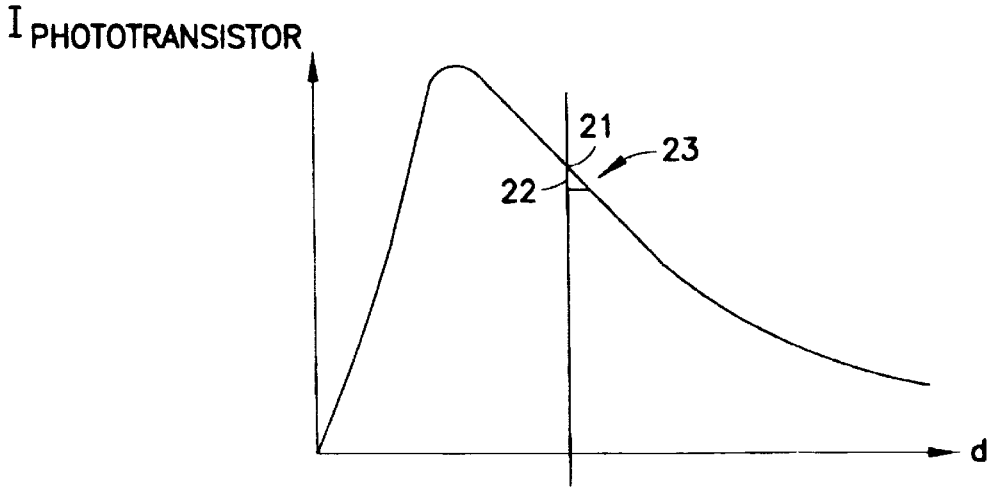
FIG. 3 is a graphical representation of the I-d characteristic of the reflex sensor.

FIG. 3 shows the relationship between the phototransistor current $I_{phototransistor}$ and the displacement distance d. Upon detection of the displacement of the printing head 1 as previously described, an operating point 21 is selected in the falling region on the I-d curve of reflex sensor 8. Starting from point 21, the slope of the curve is determined using any suitable known technique, and a small signal drop 22 having a typical magnitude of a few mV is obtained.

Figure 4:
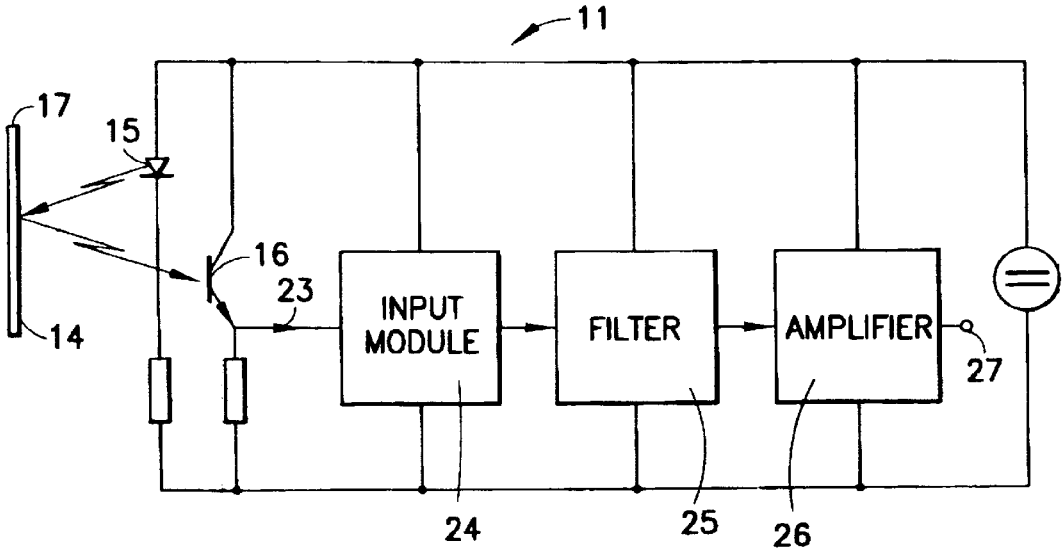
FIG. 4 is a block diagram of the evaluation circuit in accordance with an embodiment of the invention.

FIG. 4 shows the evaluation circuit 11 according to an embodiment of the present invention. Reflex sensor 8 is depicted, as shown in FIG. 1, with LED 15 and phototransistor 16 forming one side of pairing 14, and reflex surface 17 forming the other. The signal change 23, measured by phototransistor 16, is input to input module 24 which amplifies it to a level sufficient for further processing. Filter 25 receives the amplified signal from input module 24, and filters out any interference and offsets present in the signal. A second amplifier module 26 removes any residual interference present in the signal by applying a low voltage threshold to the same. The output signal 27 of amplifier 25 is a clear signal representative of the measured displacement of printing head 1 resulting from contact with the recording carrier 7. In order to eliminate any interference signals resulting from mechanical vibrations in the printer, additional software processing of output signal 27 can be performed.

Since the origin of output signal 27 is not entirely dependent on the dynamics of the printing head movement during printing, evaluation circuit 11, and more particularly filter 25, can be freely optimized to further enhance the processing of the measured signal change 23.

Figure 7:
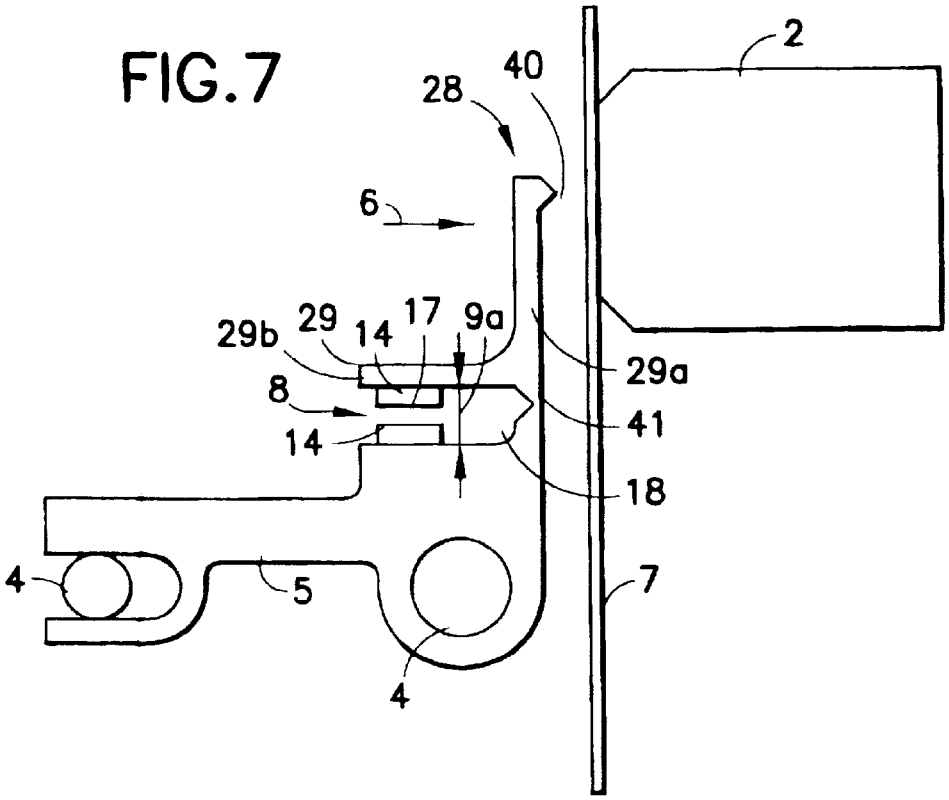
FIG. 7 is a side view of the carriage with carriage guide member and printing abutment in an initial position of a resilient element with reflex sensor in accordance with another embodiment of the present invention.

FIG. 7 shows another embodiment of the invention in which the variation in distance 9*a* of deflection and/or the angle of deflection 9*b* results from a momentary abutment of a resilient element 28 against at the recording carrier 7 and/or printing abutment 2. The reflex sensor 8 is positioned in a free space which is defined by the distance 9*a*. The element 28 may be directly formed, for example, by injection molding, to the one-piece carriage 5 as an L-shaped angular member 29 comprising a first arm 29*a* and a second arm 29*b*. Angular member 29 is secured, proximate the juncture of arms 29*a*, 29*b*, to the body of carriage 5 by a plastic link or joint 41 so that member 29 is resiliently pivotable relative to carriage 5 at joint 41. First arm 29*a* carries, at or proximate its free end opposite joint 41, a protrusion 40 that confrontingly opposes the recording carrier 7 and printing abutment 2.

Figure 8:
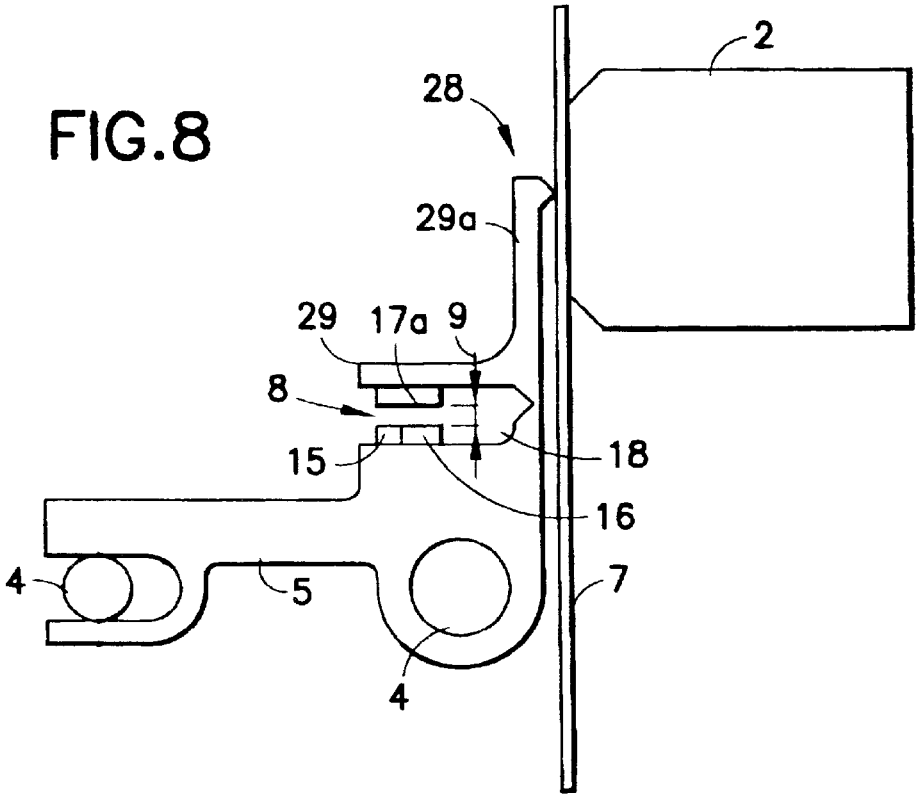
FIG. 8 is the side view of FIG. 7 showing the resilient element at the recording carrier in a contact position.

In an initial position (FIG. 7) first arm 29*a* is disposed so that protrusion 40 stands at a distance from recording carrier 7 and printing abutment 2 during or preceding the start of printing. During the brief measuring process, the carriage is advanced in the direction 6 until protrusion 40 contacts (FIG. 8) recording carrier 7 or, if the there is no paper in the printer, the printing abutment 2. This momentary contact causes pivotable movement of the member 29—i.e. of first arm 29*a* and second arm 29*b*—so that the relative spacing and/or angle between the components of reflex sensor 8 is changed or varied.

As in the previously disclosed embodiments, the reflex sensor 8 forms, on the carriage 5, a pairing 14 comprising a light emitting diode 15 and adjacently-located phototransistor 16 in the same plane, and a reflex surface 17 implemented by a mirror 17*a*.

The reflex sensor 8 may alternatively comprise a pairing 14 formed by a Hall-sensor, or a magnetically sensitive resistor, and an oppositely disposed magnet. A protected space 18 with lateral walls 19 for carrying the mentioned pairings 14 can alternatively be formed by a formation of the angular element 29 in which the arms 29*a*, 29*b* are substantially parallel, as for example shown in FIG. 9.

Figure 9:
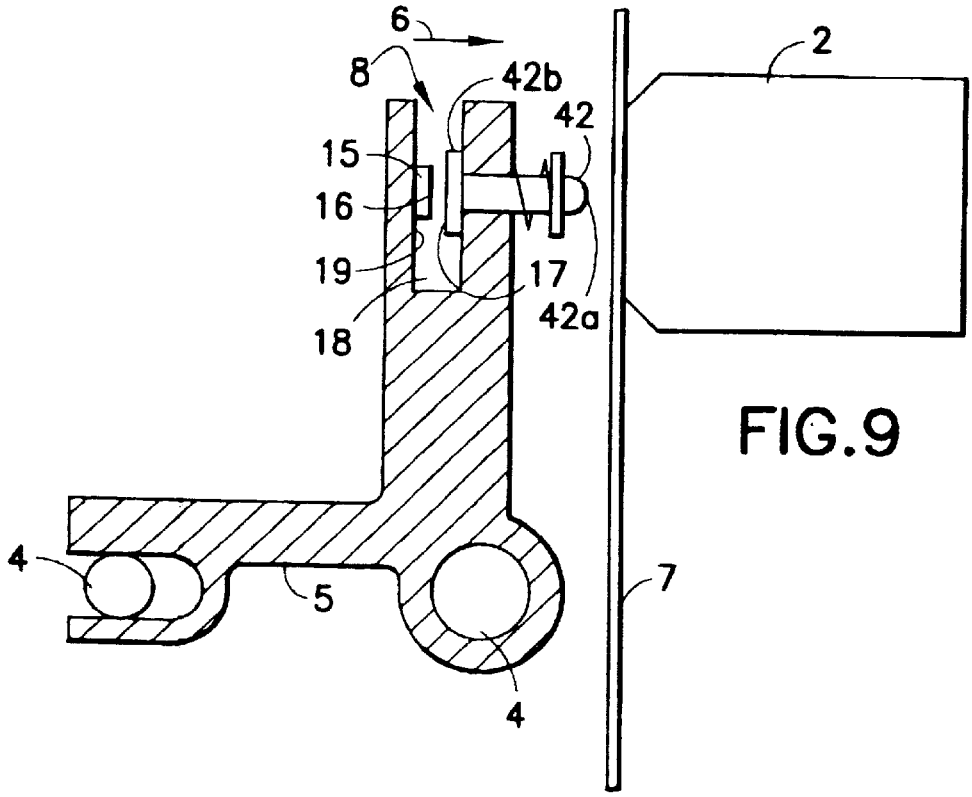
FIG. 9 is the side view of the carriage with a carriage guide member and printing abutment having a bolt-shaped resilient member in accordance with yet another embodiment of the invention.
Figure 10:
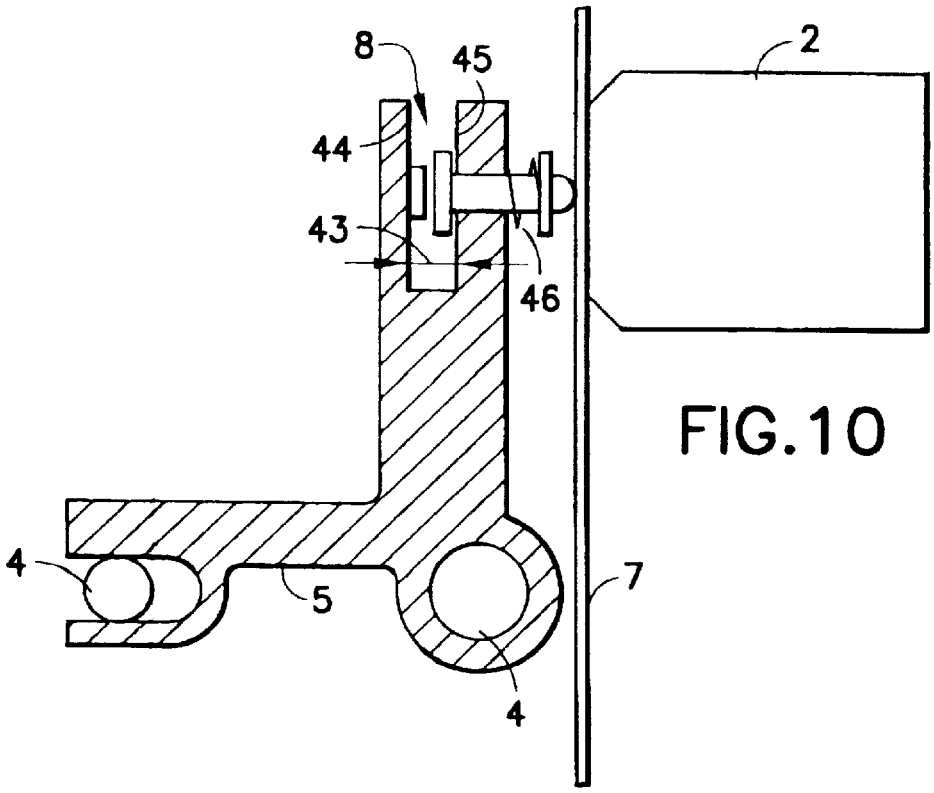
FIG. 10 is the side view of FIG. 9 showing the resilient member contacting the recording carrier and printing abutment, respectively.

A further embodiment is depicted in its alternative positions in FIGS. 9 and 10. The resilient element 28 of carriage 5 is implemented as a resiliently mounted stud-like member 42 whose front end 42*a* forms the protrusion 40 opposite recording carrier 7 and whose rear end 42*b* forms part of the reflex sensor 8. The reflex sensor 8 is arranged in carriage 5 within a predetermined slot 43, whereby the light emitting diode 15 and phototransistor 16 are disposed at the back wall 44 (sidewall 19) of slot 43 and the reflex surface 17 is disposed on the opposite front side 45 of the slot 43.

The elongated member 42 is bolt-shaped and is slidable within a bore defined through carriage 5. Reflex surface 17 is integrally formed on its rear end 42*b*. The basic or initial position of the sensor 42 is maintained by the return urgency of a pressure spring 46 that is disposed on and about the shaft of the bolt 42.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. In a printer having a printing abutment for supporting a recording carrier to be printed, a print head operable for printing on the recording carrier, and a carriage for supporting the print head and operatively movable in a first direction parallel to the printing abutment and supported recording carrier for printing on the recording carrier and in a second direction substantially perpendicular to the printing abutment and supported recording carrier for adjusting a spacing between a print surface of the print head and the recording carrier, the invention comprising apparatus for adjusting the spacing through controlled movement of the carriage along the second direction in response to variations in a thickness of the supported recording carrier so as to enable optimum printing quality, said apparatus comprising:

means mounting the print head to the carriage so as to accommodate displacement of the print head relative to the carriage along said second direction by momentary abutment of the print head print surface with the recording carrier;

a second surface on the print head remote from the print surface and disposed in confrontingly opposed relation to the carriage and defining therebetween a clearance that is variable in one of said second direction and a third direction defined at an angle to the second direction as the print head is displaced relative to the carriage along said second direction by said momentary abutment of the print head print surface with the recording carrier; and reflex sensor means for detecting said variations in said clearance and for outputting an electrical signal for use in effecting controlled movement of the carriage along said second direction to properly adjust the spacing between the print surface of the print head and the supported recording carrier in accordance with said detected variations so as to accommodate the thickness of the supported recording carrier.

2. The apparatus as claimed in claim 1, wherein said reflex sensor means is disposed in said clearance.

3. The apparatus as claimed in claim 1, further comprising an evaluation circuit for receiving said electrical signal as a difference signal defined by the variation in said clearance as the print head abuts the supported recording carrier, and for processing the difference signal by filtering and amplifying the difference signal to generate an output signal for use in effecting said controlled movement of the carriage along said second direction to properly adjust the spacing between the print surface of the print head and the supported recording carrier.

4. The apparatus as claimed in claim 1, wherein said mounting means comprises a spring for resiliently fastening the printing head to the carriage in a downward direction relative thereto, and an elastic layer disposed between said printing head and said carriage.

5. The apparatus as claimed in claim 1, wherein said reflex sensor means comprises a light emitting diode for operatively emitting an optical signal, a reflex surface for receiving the emitted optical signal and for reflecting the received emitted optical signal from the reflex surface, and a phototransistor for receiving the reflected optical signal from the reflex surface, said light emitting diode, reflex surface and phototransistor being arranged in said clearance so that a distance that the optical signal travels from said light emitting diode to said phototransistor varies with variations in said clearance.

6. The apparatus as claimed in claim 5, wherein said reflex surface comprises a mirror.

7. The apparatus as claimed in claim 1, wherein said reflex sensor means comprises a magnet disposed on one of the print head second surface and the carriage for generating a magnetic field, and a Hall sensor disposed on the other of the print head second surface and the carriage for detecting a strength of the generated magnetic field, said Hall sensor and said magnet being arranged in said clearance so that the detected strength of the generated magnetic field varies with variations in said clearance.

8. The apparatus as claimed in claim 1, wherein said reflex sensor means comprises a magnet disposed on one of the print head second surface and the carriage for generating a magnetic field, and a magnetically sensitive resistor disposed on the other of the print head second surface and the carriage for detecting a strength of the generated magnetic field, said magnet and said magnetically sensitive resistor being arranged in said clearance so that the detected strength of the generated magnetic field varies with variations in said clearance.

9. The apparatus as claimed in claim 1, further comprising a protected space defined by said second surface on the print head, a vertical surface of the carriage facing away from the printing abutment, and a lower surface of a front portion of said print head, said clearance being within said protected space.

10. In a printer having a printing abutment for supporting a recording carrier to be printed, a print head operable for printing on the recording carrier, and a carriage for supporting the print head and operatively movable in a first direction parallel to the printing abutment and supported recording carrier for printing on the recording carrier and in a second direction substantially perpendicular to the printing abutment and supported recording carrier for adjusting a spacing between a print surface of the print head and the recording carrier, the invention comprising apparatus for adjusting the spacing through controlled movement of the carriage along the second direction in response to variations in a thickness of the supported recording carrier so as to enable optimum printing quality, said apparatus comprising:

means mounting the print head to a first portion of the carriage;

means on the carriage for accommodating resilient relative movement between the print head and a second portion of the carriage by momentary abutment of one of the print head print surface and the second carriage portion with the recording carrier;

a clearance defined between a first surface and a second surface spaced from said first surface at a distance that varies with said resilient relative movement between the print head and said carriage second portion by said momentary abutment of the print head print surface with the recording carrier, said first surface being defined on one of said carriage first portion and the print head, and said second surface being defined on said carriage second portion; and reflex sensor means for detecting said variations in said clearance distance and for outputting an electrical signal for use in effecting controlled movement of the carriage along said second direction to properly adjust the spacing between the print surface of the print head and the supported recording carrier in accordance with said detected variations so as to accommodate the thickness of the supported recording carrier;

wherein said means mounts the print head to the first portion of the carriage so as to accommodate resilient displacement of the print head relative to the carriage second portion along said second direction by momentary abutment of the print head print surface with the recording carrier, and wherein said first surface comprises a remote surface on the print head remote from the print surface and disposed in confrontingly opposed relation to the second surface.

* * * * *